United States Patent [19]

Hays et al.

[11] 4,185,519

[45] Jan. 29, 1980

[54] RATCHET MECHANISM FOR HAND TOOLS

[75] Inventors: Kenneth S. Hays, Exton, Pa.; Gustaf R. Lawson, Willingboro, N.J.

[73] Assignee: AMP Incorporated, Harrisburg, Pa.

[21] Appl. No.: 873,565

[22] Filed: Jan. 30, 1978

[51] Int. Cl.[2] ..... G05G 5/24; B25B 7/14

[52] U.S. Cl. ..... 74/577 S; 81/337

[58] Field of Search ..... 74/577 M, 577 S, 577 R, 74/577 SF, 575; 81/313, 337, 338

[56] References Cited

U.S. PATENT DOCUMENTS

| | | | |
|---|---|---|---|
| 3,277,751 | 10/1966 | Filia | 81/313 |
| 4,062,218 | 12/1977 | Wiener | 72/409 |

*Primary Examiner*—Kenneth Dorner

*Attorney, Agent, or Firm*—Allan B. Osborne

[57] ABSTRACT

The present invention relates to a ratchet mechanism for compelling precise operation of a hand tool as well as a device thereon for releasing the mechanism. More particularly, the invention includes a ratchet plate, releasable pawl and a guard plate.

1 Claim, 3 Drawing Figures

RATCHET MECHANISM FOR HAND TOOLS

BACKGROUND OF THE INVENTION

1. Field of the Invention

The invention is directed to hand tools of the type having a ratchet and pawl mechanism such that once the closing action begins, it cannot be terminated without completing the full stroke.

2. The Prior Art

U.S. Pat. No. 2,696,747 discloses a hand operated tool with a full-stroke compelling mechanism. The compelling mechanism comprises a ratchet on one handle and a pivoted mounted pawl on the other. As the one handle is advanced towards the other, the nose of the pawl slips by the series of teeth on the ratchet. However, if a reversal in the direction of travel is attempted, the pawl jams up against a tooth or more precisely a section between adjacent teeth. Thus, once a closing action begins it must be follow through. The importance of this is that a uniform pressure is applied against objects placed between the jaws of the tool.

SUMMARY OF THE INVENTION

The present invention teaches a ratchet mechanism having means thereon for releasing the ratchet mechanism and also means for preventing the ratchet from being deformed by overstress.

DESCRIPTION OF THE PREFERRED EMBODIMENT

Figure 1:
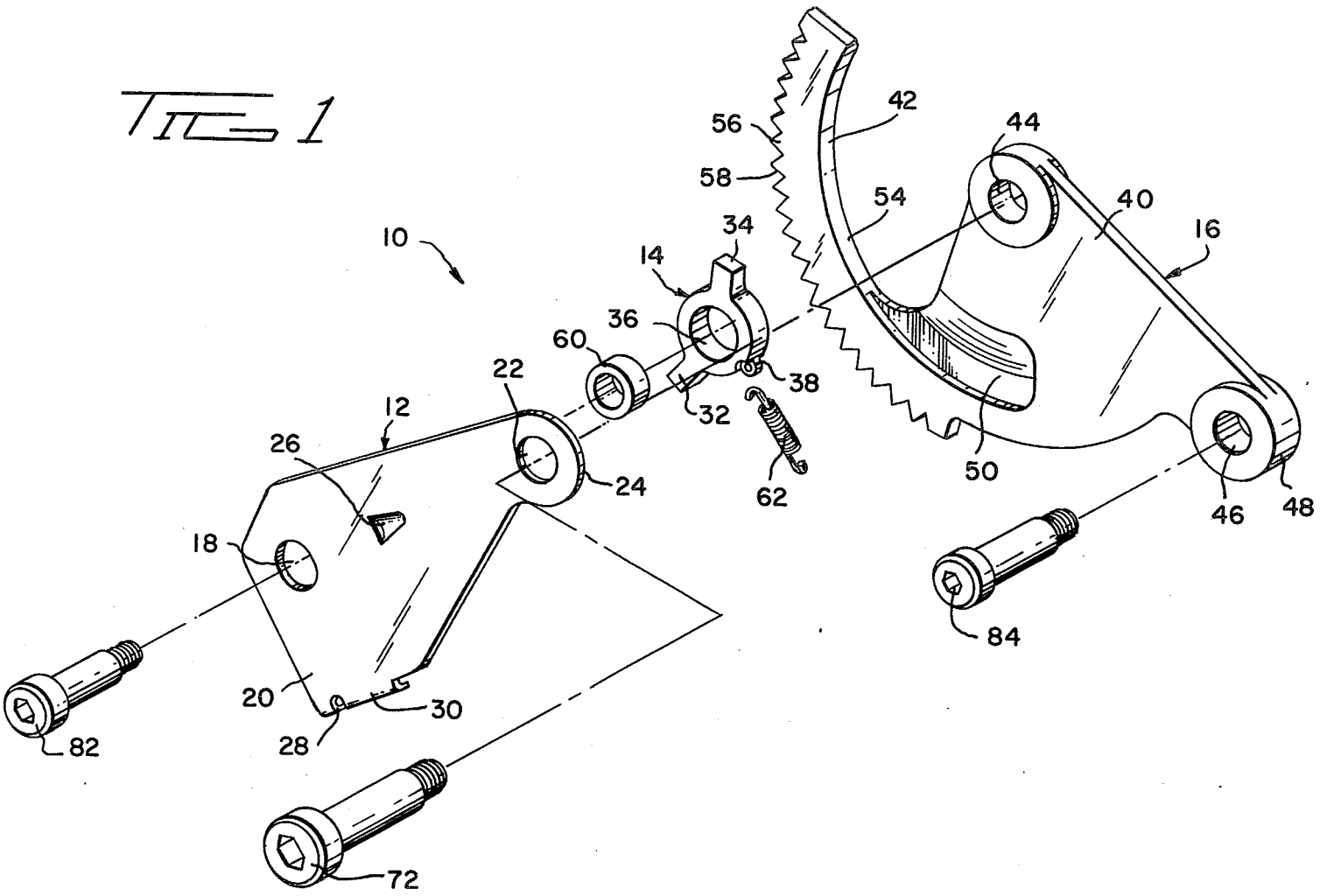
FIG. 1 is an exploded, perspective view of the ratchet mechanism constructed in accordance with the preferred embodiment of the present invention.

The ratchet mechanism, generally indicated by the numeral 10, includes a guard plate 12, pawl 14 and ratchet 16.

Guard plate 12 has a pin receiving hole 18 at one end 20 and a second such hole 22 at another end 24. An inwardly projecting lance 26 is provided in the plate on a bisecting line between the two pin receiving holes. A notch 28 is located on lateral side 30 of the plate.

Pawl 14 may be described as ring-shaped with a pair of fingers, 32 and 34, and a center hole 36. The two fingers extend laterally away from the ring and are spaced about 160 degrees from each other. A hook-receiving opening 38 on the ring's perimeter is positioned about 100 degrees from either finger.

Ratchet plate 16 has a somewhat triangular-shaped portion 40 and a curved arm 42 extending from the portion on an arc with a first pin-receiving hole 44 being at the center. A second pin-receiving hole 46 is located at an end 48 remote from arm 42. Both holes are encircled by an increase in material thickness. A recess 50 is milled into the surface 52 of portion 40. This recess provides a continuation of inside edge surface 54 of arm 42. The outer edge surface of the arm has a number of teeth 56 which provide angled sides 58. The ends of the arm are equally spaced from the aforementioned first pin-receiving hole 44 so as to place that hole at the center of the arc described by the arm.

Bushing 60 and coil spring 62 complete the components of the ratchet mechanism.

Figure 2:
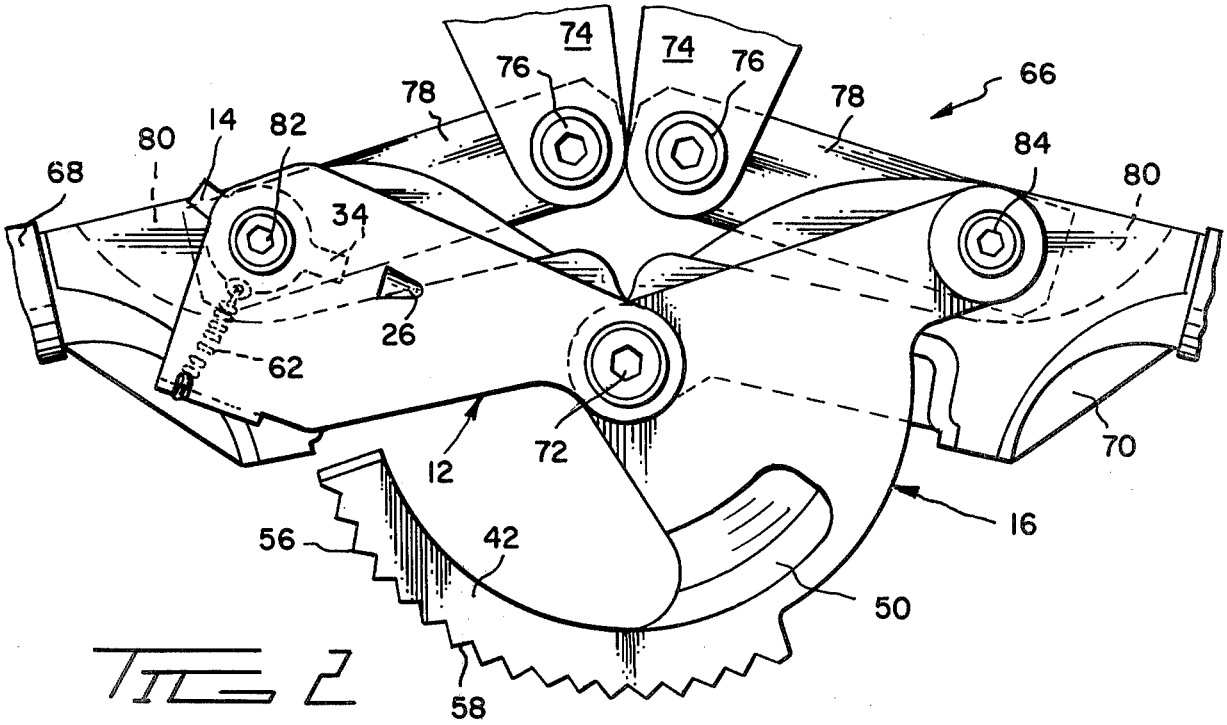
FIG. 2 is a view of the ratchet mechanism of FIG. 1 installed on a hand tool showing the location of the several parts in an open position.
Figure 3:
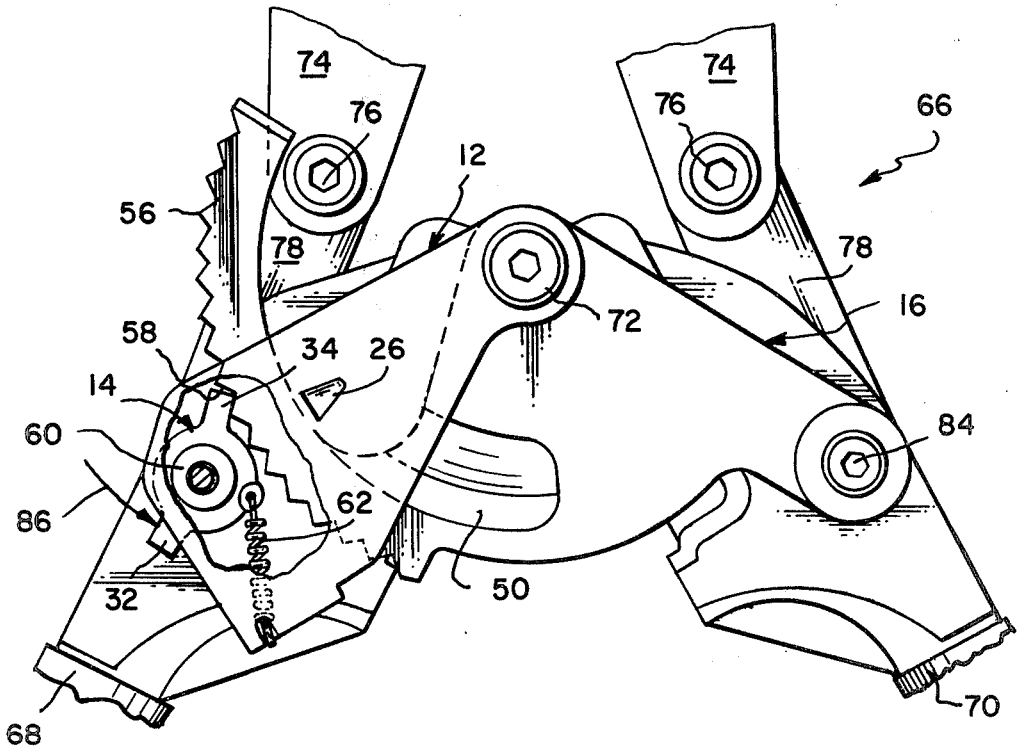
FIG. 3 is a view similar to FIG. 2 but where the hand tool has been partially closed.

FIGS. 2 and 3 show in part the type of hand tool on which ratchet mechanism 10 may be utilized. Such a tool generally has a pair of long handles pivotally connected to each other. A pair of jaw plates, pivotally connected directly to the handles or indirectly by means of links, contain the metal working pieces such as crimping dies. Such tools are described in substantial detail in U.S. Pat. No. 3,410,129.

With specific respect to the tool, designated by reference numeral 66, shown in FIGS. 2 and 3, the part shown includes the upper ends of left handle 68 and right handle 70. These two handles are pivotally connected together at the extreme upper ends by a pin 72. A pair of jaws 74 (shown only very partially) are pivotally connected by pins 76 to links 78 which extend from slots 80 in the two handles and are secured thereto by pin 82 on handle 68 and pin 84 on handle 70.

Ratchet mechanism 10 is assembled onto tool 66 by first positioning ratchet plate 16 so that end 48 is secured to handle 70 by pin 84 passing through hole 46 and another end of the ratchet plate being positioned so to be secured by pin 72 passing through hole 44. Arm 42 extends towards handle 68.

Pawl 14 is placed onto handle 68 over the hole therein which receives pin 82. One hooked end of coil spring 62 is slipped through opening 38 in the pawl. Bushing 60 is placed over center hole 36.

Guard plate 12 is positioned so that pin receiving hole 18 is over bushing 60 on handle 68 and hole 22 is over and aligned with hole 44 on the ratchet plate. Pins 72 and 82 secure the mechanism to the tool as shown.

The other hooked end of coil spring 62 is hooked over notch 28. This biases the pawl to a neutral position where finger 34 lies along the axis from pivot 72 to pivot 82.

As handles 68 and 70 are brought together arm 42 slides between lance 26 and finger 34 on pawl 14. The teeth on the arm engage finger 34 and rotate the pawl counter-clockwise. Spring 62 maintains a clockwise counter force on the pawl. Lance 26 supports arm 42 against deformation by overstressing the handles.

As seen in FIG. 3, finger 34 abuts against an angled side 58; thus once the handles are started into a closing position, their direction of travel cannot be stopped in the absence of the release mechanism provided on the pawl. The release mechanism consists of the second finger 32 on the pawl. By pushing in on that finger in the direction shown by arrow 86, finger 34 can be rotated counter-clockwise out of engagement with teeth 56 and sides 58. The two handles may then be drawn apart. Note that the release requires a deliberate movement by the tool operator.

Recess 50 prevents interference by the inwardly projecting lance 26 as the handles fully close.

The foregoing detailed description has been given for clearness of understanding only, and no unnecessary limitations should be understood therefrom, as some modifications will be obvious to those skilled in the art.

What is claimed is:

1. A ratchet mechanism for use on a tool having first and second handles pivotally mounted together at a pivot point adjacent one end, said mechanism comprising:

a. a ring-shaped pawl having a first finger projecting laterally therefrom;

b. attaching means pivotally attaching the pawl to the first handle near the pivot point;

c. a guard plate attached to one end by said attaching means to the first handle in overlying relation to the pawl and attached at another end to the pivot point of the first and second handles, said guard plate having an inwardly projecting lance spaced between the two ends;

d. a ratchet plate having a first end, a second end and a curved arm with a plurality of teeth on its outer edge, said arm being spaced from and extending in an arc about the second end, said plate being positioned between the guard plate and the handles and on the same horizontal plane as the pawl with the ratchet plate's first end being pivotally mounted to the second handle and its second end being pivotally mounted at the pivot point of the first and second handles so that the arm is movably positioned between the pawl and the inwardly projecting lance so that its teeth may engage the pawl for forward compelling motion and the inwardly projecting lance may abutt the arm's inside edge to prevent non-rotational movement of the arm.

* * * * *